United States Patent [19]

Woods

[11] Patent Number: 4,928,625

[45] Date of Patent: May 29, 1990

[54] PENDULUM MOUNTED AIRBRUSH

[75] Inventor: William A. Woods, Redford, Mich.

[73] Assignee: Spirotron Corporation, Detroit, Mich.

[21] Appl. No.: 412,189

[22] Filed: Sep. 25, 1989

[51] Int. Cl.[5] ..... B05B 13/04; B05C 5/00

[52] U.S. Cl. ..... 118/323; 427/256

[58] Field of Search ..... 118/323, 300, 256, 321; 427/286, 256

[56] References Cited

U.S. PATENT DOCUMENTS

| | | | |
|---|---|---|---|
| 1,162,717 | 11/1915 | White | 118/323 |
| 1,835,402 | 12/1931 | Juers | 118/323 |
| 3,021,227 | 2/1962 | Richardson | 118/323 |
| 4,463,467 | 8/1984 | Gruben et al. | 118/325 |

*Primary Examiner*—Jay H. Woo
*Assistant Examiner*—K.P. Nguyen
*Attorney, Agent, or Firm*—Beaman & Beaman

[57] ABSTRACT

The invention pertains to an apparatus for painting abstract designs on various substrate utilizing pendulum motion. The apparatus includes a frame member from which a pendulum mass is suspended by support cables over a substrate support, free to swing under the influence of gravity, whereby the pendulum mass supports means for painting a pattern on the associated substrate during pendulum movement. The pendulum supports apparatus whereby various colors of paint may be selected and applied to create unique multi-colored abstracts.

11 Claims, 1 Drawing Sheet

PENDULUM MOUNTED AIRBRUSH

BACKGROUND OF THE INVENTION

The simple pendulum, which is commonly used in scientific demonstrations, consists of a small heavy mass, suspended from a fixed point by a thread of negligible weight whereby the mass is free to swing under the influence of gravity. Swinging of the mass is initiated by the operator and various diverse patterns of motion may be obtained. Pendulum motion has intrigued the curious and scientifically minded persons and it has been realized that such patterns would produce unique abstract designs.

It is an object of the invention to provide an apparatus for painting abstract patterns on various substrate, such as clothing, utilizing pendulum motion wherein the apparatus includes a pendulum mass free to swing under the influence of gravity and paint applying means are defined on the mass capable of painting a pattern on the associated substrate as the mass is swinging.

Another object of the invention is to provide an apparatus for painting abstract patterns on various substrate utilizing pendulum motion including a pendulum mass employing paint applying means capable of applying various colors of paint wherein the operator initiates the swinging pattern of the mass and controls the release of desired colors.

A further object of the invention is to provide an apparatus for painting abstract patterns on various substrate utilizing pendulum motion including a pendulum mass employing paint applying means wherein the paint applying means comprise an air brush mounted on the mass and a control switch operatively associated with the air brush remotely located from the mass is provided to control the brush as the mass is swinging without hindering the motion of the mass.

Yet a further object of the invention is to provide an apparatus for painting abstract patterns on various substrate utilizing pendulum motion including a pendulum mass employing paint applying means wherein the distance between the mass and substrate support may be varied to accommodate for different size substrate and to control the width of the pattern being applied.

Still a further object of the invention is to provide an apparatus for painting abstract patterns on various substrate utilizing pendulum motion wherein the mass employs paint applying means and is suspended from a frame member by a rigid bar attached to a universal joint whereby the mass is capable of swinging freely in all angular and rotational directions with respect to the frame member.

In the practice of the invention a pendulum mass is suspended from a frame by cables over a substrate support, free to swing under the influence of gravity, and the mass supports an air brush or other paint applying device for painting a pattern on the associated substrate, such as a tee shirt corresponding to the path of the swinging mass. The air brush is capable of applying several different colors of paint, separately or simultaneously, and the operator initiates the swinging pattern of the mass and selects the color combination. A height adjustment assembly permits the distance between the mass and the substrate support to be varied to accommodate various size substrate and to control the width of the pattern being applied. Also, the mass may be suspended from a rigid bar attached to a universal joint permitting axial rotation of the mass as it is swinging to generate patterns having sinusoidal characteristics.

The pendulum mass and paint applying means may take several forms in accord with the inventive concepts. In one embodiment the paint reservoir is located on the mass and the paint simply flows, or drips, through one or more openings due to the force of gravity. The reservoir may consist of one or more separate compartments homogeneously formed within the mass, each compartment capable of containing a separate color of paint, or may consist of separate paint containers mounted on the mass.

In another embodiment of the invention the paint reservoir is formed in the same manner as described above, however, the paint reservoir is under internal pressure like conventional spray paint cans and the paint is sprayed on the substrate through one or more controlled openings.

In a further embodiment of the invention the paint reservoir is located in a separate container remote from the mass and the paint is applied to the substrate through an air brush mounted on the mass. The air brush is connected to an air compressor and paint reservoir assembly by a hose, or hoses, and the paint reservoir may contain several colors of paint. A switch remotely located from the mass operatively associated with the air brush allows the air brush to be controlled as the mass is swinging.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

The invention utilizes pendulum motion to paint unique abstract designs on various substrate such as art or illustration boards, poster boards and clothing articles of various textiles. A typical apparatus in accord with the invention includes a frame member from which a pendulum mass is suspended by cables over a substrate support free to swing under the influence of gravity wherein the mass employs a paint applying device capable of painting a pattern on the substrate corresponding to the path of the swinging mass. The pendulum mass may take several forms and the paint may be applied in several different manners in accord with the inventive concepts.

Figure 1:
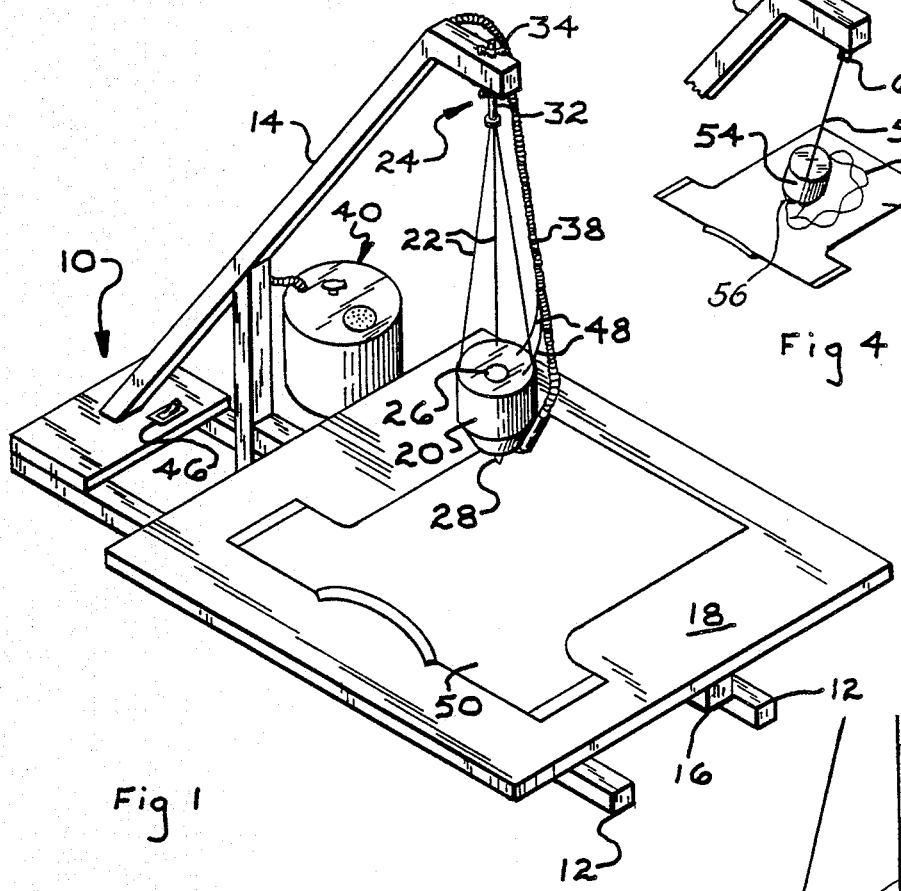
FIG. 1 is a perspective view of a pendulum mounted paint applying apparatus constructed in accord with the invention, illustrating a tee shirt positioned on the substrate support prior to painting a pattern on the tee shirt.

With reference to FIG. 1, a frame constructed in accord with the invention generally indicated at 10, includes a pair of parallel legs 12, an extension arm 14, and a support bar 16 whereon a board 18 is mounted to support the substrate to be painted. A pendulum mass 20 is supported by three cables 22 which are attached at one end to the extension arm 14 by a height adjustment assembly 24 and at the other end to the mass 20 permitting the mass to swing freely over the board 18. The mass 20 is of a generally cylindrical configuration and is provided with an axial bore 26 wherein an air brush 28 is located having a paint applying end extending toward the substrate through which the paint being applied is sprayed. The air brush 28 is retained in the bore 26 by a set screw 30, FIG. 2, and the height adjustment assembly 24 includes a threaded rod 32 and a pair of wing shaped nuts 34 which mount the rod to the arm 14 and are manually adjustable to allow the distance between the air brush 28 and the substrate support 18 to be varied.

Figure 2:
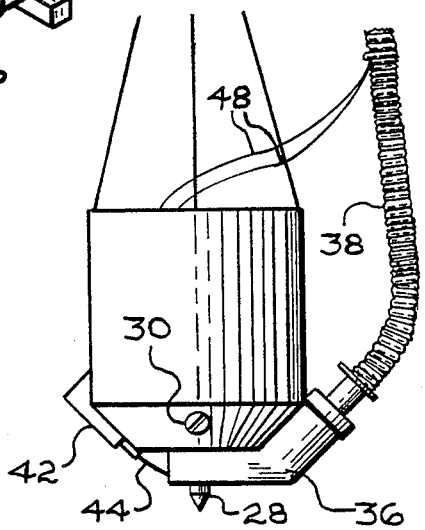
FIG. 2 is an elevational, enlarged, detail, view of the pendulum mass and air brush assembly of FIG. 1.

As will be best appreciated in FIG. 2, the air brush 28 includes an adapter 36, which receives one end of a hose 38, and the other end of the hose is attached to an air compressor paint reservoir assembly generally indicated at 40 in FIG. 1. The paint reservoir 40 may be divided into separate compartments, not shown, each capable of containing a separate color of paint or may simply consist of a single compartment containing just one color. The hose 38 may surround a plurality of smaller diameter hoses, not shown, each capable of extending into a separate compartment, or may simply consist of a single line. A solenoid 42 operatively associated with the air brush 28 facilitates turning the brush "off" and "on" and is also used to control the color of paint being applied.

The solenoid 42 is received in a cavity, not shown, defined in the mass 20 and activates a trigger 44 which opens and closes a valve in the air brush turning the brush "on" and "off", respectively. A switch 46, FIG. 1, remotely spaced from the mass 20 is connected to the solenoid 42 via electrical wires 48, and permits the solenoid 42 to be activated and deactivated while the mass is moving.

In use, the substrate to be painted is positioned on the board and for purpose of illustration a tee shirt 50 is shown in FIG. 1 prior to being painted. The swinging of the mass 20 is initiated by the operator and once the desired pattern is obtained the operator may turn the switch 46 "on" causing the paint to be sprayed on the tee shirt 50 generating a pattern as indicated at 52 in FIG. 3, and at any time the switch may be turned "off" and "on" again. If desired, the operator may also select a different color of paint while the mass 20 is swinging, as well as adjust the height adjustment assembly 24 to control the color combination and width of the pattern being sprayed, respectively.

Figure 4:
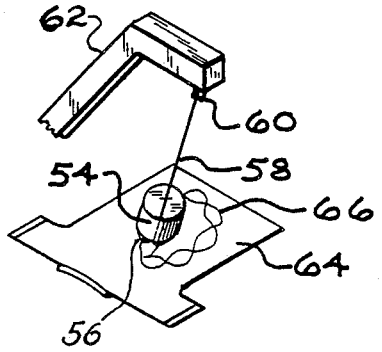
FIG. 4 is a partial, perspective view of another embodiment of a pendulum mounted paint apparatus in accord with the invention, the paint reservoir being located on the mass.
Figure 3:
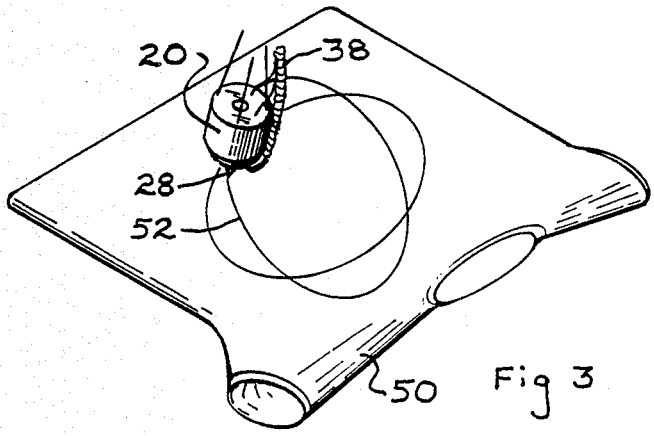
FIG. 3 is a partial, perspective view of the pendulum mounted paint apparatus of FIGS. 1 and 2, the pendulum mass and air brush being shown at a point in time during the free swing painting of an abstract design on the tee shirt.

A variation of the inventive concepts of FIGS. 1–3 is shown in FIG. 4, wherein the paint reservoir is located on the mass. The pendulum mass paint reservoir unit is generally indicated at 54, and the unit 54 may take many forms. The reservoir portion may consist or a single compartment or may include several compartments each capable of containing a separate color of paint, and the reservoir portion may either be mounted to a mass body forming the unit 54, or constitute the mass portion directly.

The unit 54 includes one or more openings, indicated at 56, through which the paint is dispersed to the associated substrate. The paint may flow, or drip, through the openings 56 due to the force of gravity, or the reservoir may be pressurized and the paint is sprayed through the openings 56 in a manner similar to conventional spray paint cans.

The unit 54 is suspended by a light weight rigid bar 58 which is attached to a universal joint 60 mounted to an arm 62, whereby the unit 54 is free to swing under the influence of gravity over a substrate support, not shown, in all angular and rotational directions. The arm 62, only partially shown, may extend from a frame member similar to the frame member 10 of FIG. 1.

In use, the operator initiates the axial rotation and swinging of the pendulum unit 54 and the paint is dispersed to the associated substrate in any one of the aforedescribed manners. For purpose of illustration a tee shirt 64 is shown in FIG. 4 whereby a pattern is shown as indicated at 66 being painted on the shirt 64 having sinusoidal characteristics.

It is to be understood that the inventive concepts are not limited to the described embodiments, but other variations or combinations of paint applying means defined on a pendulum mass are also within the scope of the invention. For instance, an air brush may be employed on a pendulum mass also utilizing flow openings to disperse the paint, or a funnel may be filled with paint and swung over a substrate whereby the paint flows through the smaller end of the funnel onto the substrate. It is also to be appreciated that other modifications to the inventive concepts may be apparent to those skilled in the art without departing from the spirit and scope of the invention.

I claim:

1. An apparatus for painting unique abstract designs on substrate utilizing pendulum motion, comprising, in combination, a frame member, a pendulum mass, support means suspending said mass from said frame member permitting said mass to swing freely in any direction under the influence of gravity, a substrate support located below said pendulum mass, a reservoir capable of containing one or more colors of a pigment containing medium, and medium applying means defined on said pendulum mass in communication with said reservoir capable of applying said one or more colors of said medium to the associated substrate as said mass is swinging.

2. In an apparatus as in claim 1, said reservoir being defined on said mass, said medium applying means comprising at least one opening formed in said reservoir extending toward the associated substrate, said one or more colors of medium flowing through said one or more openings due to the force of gravity.

3. In an apparatus as in claim 2, said reservoir being of a higher internal pressure than the ambient atmospheric pressure, said medium being sprayed through said one or more openings do to said internal pressure.

4. In an apparatus as in claim 3, said support means comprising a hook assembly and at least one support cable, said hook assembly mounted to said frame and said cable being attached at one end to said hook assembly and at the other end to said mass.

5. In an apparatus as in claim 3, said support means comprising a rigid bar attached at one end to said mass and at the other end to a universal joint mounted to said frame member permitting free movement of said mass in all angular and rotational directions with respect to said frame member.

6. In an apparatus as in claim 1, said support means including adjustable means for adjusting the vertical distance between said medium applying means and said substrate support.

7. An apparatus for painting unique abstract designs on substrate utilizing pendulum motion, comprising, in combination, a pendulum mass, a frame member, support means suspending said mass from said frame member permitting said mass to swing freely in any direction under the influence of gravity, a substrate support located below said pendulum mass, a paint reservoir remotely located from said pendulum mass capable of containing one or more different colors of paint, a paint applicator defined on said mass in communication with said paint reservoir capable of applying said paint on the associated substrate as said mass is swinging.

8. In an apparatus as in claim 7, said paint applicator comprising an air brush connected to said paint reservoir, an air compressor, and a hose connecting said compressor and air brush.

9. In an apparatus as in claim 8, manually operable control means for controlling said air brush.

10. In an apparatus as in claim 8, said manual control means comprising a solenoid controlling flow through said air brush, a switch in electrical communication with said solenoid remotely located from said mass, said solenoid being operable while said mass, is swinging without hindering the motion thereof.

11. In an apparatus as in claim 9, means for selecting a particular color of paint to be sprayed, said selection means permitting a different color of paint to be selected as said mass is swinging.

* * * * *